US008240403B2

(12) United States Patent
Trinh et al.

(10) Patent No.: US 8,240,403 B2
(45) **Date of Patent: *Aug. 14, 2012**

(54) EARTH-BORING TOOLS WITH IMPROVED RETENTION OF CUTTING ELEMENTS INSTALLED WITHIN POCKETS

(75) Inventors: Tu Tien Trinh, Houston, TX (US); Eric C. Sullivan, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/901,259

(22) Filed: Oct. 8, 2010

(65) Prior Publication Data

US 2011/0017518 A1 Jan. 27, 2011

Related U.S. Application Data

(63) Continuation of application No. 12/237,421, filed on Sep. 25, 2008, now Pat. No. 7,836,792.

(51) Int. Cl.
*E21B 10/36* (2006.01)
*B21K 5/04* (2006.01)

(52) U.S. Cl. ..... 175/426; 175/435; 76/108.2

(58) Field of Classification Search ..... 175/331, 175/374, 426, 428, 432, 433, 354; 76/108.2
See application file for complete search history.

(56) References Cited

U.S. PATENT DOCUMENTS

| | | | | |
|---|---|---|---|---|
| 4,037,300 | A | 7/1977 | Garner | |
| 4,249,621 | A | 2/1981 | Espana | |
| 4,303,137 | A | 12/1981 | Fischer | |
| 4,358,384 | A | 11/1982 | Newcomb | |
| 4,593,776 | A | 6/1986 | Salesky et al. | |
| 4,623,028 | A | 11/1986 | Murdoch et al. | |
| 4,660,444 | A * | 4/1987 | Sorensen et al. | 76/108.2 |
| 4,708,752 | A | 11/1987 | Kar | |
| 4,744,270 | A * | 5/1988 | Vezirian | 76/108.2 |
| 4,823,893 | A * | 4/1989 | Cantrel | 175/426 |
| 4,867,015 | A * | 9/1989 | Kane et al. | 76/108.2 |
| 4,887,493 | A * | 12/1989 | Drake | 76/5.1 |
| 5,624,002 | A | 4/1997 | Huffstutler | |
| 5,671,817 | A | 9/1997 | Smith et al. | |
| 6,170,576 | B1 * | 1/2001 | Brunnert et al. | 166/298 |
| 6,176,330 | B1 | 1/2001 | Burr | |
| 6,287,360 | B1 | 9/2001 | Kembaiyan et al. | |
| 6,571,889 | B2 | 6/2003 | Griffo et al. | |
| 7,036,613 | B2 | 5/2006 | Burr | |
| 7,121,365 | B2 | 10/2006 | Denton et al. | |
| 2004/0068090 | A1 * | 4/2004 | Ogawa et al. | 528/335 |
| 2004/0245022 | A1 | 12/2004 | Izaguirre et al. | |
| 2006/0260846 | A1 | 11/2006 | Portwood et al. | |
| 2010/0071512 | A1 | 3/2010 | Trinh et al. | |

* cited by examiner

*Primary Examiner* — Brad Harcourt
*Assistant Examiner* — Michael Wills, III
(74) *Attorney, Agent, or Firm* — TraskBritt

(57) ABSTRACT

A rock bit is formed with pockets for enhanced cutting element retention and support of cutting elements during operation of the rock bit. Portions of the pockets are carburized to increase a yield strength of the pockets, which also increases the retention of the cutting elements. The pockets are formed at a diameter that is slightly smaller than an outer diameter of the cutting elements. Portions of the pockets are then carburized. The pockets are heated until the diameter of the pockets is equal to the outer diameter of the cutting elements. After the rock bit has been cooled and cleaned, a material is placed in each pocket prior to installing the cutting elements. The material homogenizes support for the cutting elements during operation of the rock bit.

19 Claims, 4 Drawing Sheets

EARTH-BORING TOOLS WITH IMPROVED RETENTION OF CUTTING ELEMENTS INSTALLED WITHIN POCKETS

CROSS-REFERENCE TO RELATED APPLICATION

This application is a continuation of U.S. patent application Ser. No. 12/237,421, filed Sep. 25, 2008, now U.S. Pat. No. 7,836,792, issued Nov. 23, 2010, the disclosure of which is hereby incorporated herein by this reference in its entirety.

TECHNICAL FIELD

The present invention relates in general to cutting elements for rock bits and, in particular, to an improved system, method and apparatus for enhanced cutting element retention and support in a rock bit.

BACKGROUND

Rock cutting structures are commercially manufactured using a supporting structure which may be cast, forged and machined. The supporting structure supports rock cutting elements which may be formed either as an integral part of the supporting structure, or as a separate element that is joined to the supporting structure by being forced into an undersized retaining bore formed by, and within, the supporting structure to effect a tight interference fit therewith.

Various sequencing and scheduling strategies are resorted to in manufacturing in order to avoid heat treatments after the cutting elements are pressed into place. This avoids thermal relaxation of the induced stresses provided by the pressing operation. Such a reduction of induced stresses would result in an unacceptable reduction in the retention or holding force provided by the interference fitting operation.

The steels commonly used to produce rock bit cutting structures are graded, which carburize or nitride readily, thus providing a relatively soft core with a hard wear-resistant skin. To form this hard skin on the inner surface of the retention bores would seriously interfere with the installation of the teeth therein, so generally the supporting structure is first carburized, then the carburized surface is machined away in the locations intended for retention bores, then hardened with a heat treatment before the retention bores are machined.

A conventional three-cone rotary rock bit has, typically, from about 100 to about 300 inserted teeth, each of which is carefully fit to provide about 0.004 inch interference fit. Tests indicate that about 0.001 inch interference fit remains as stored stress within the assembly after the pressing, the rest being lost to shearing, galling, and yielding of the steel of the supporting structure. The roller cones and teeth are washed before insertion of the teeth, and no lube is used to install them—they are press fit only. Thus, no fluid is intentionally left behind in the pockets when the teeth are installed.

The irregular heavy impact loads imposed upon the rock bit assembly during drilling tend to cause further yielding in the supporting structure with the subsequent enlargement of retaining bores, and, occasionally, the resultant loss of hard-metal rock cutting teeth within the well bore. Such a lost tooth is no longer operational as a cutting device against rock, but does constitute a source of considerable damage or fracture to the remaining teeth in the rock bit. Serious damage can also occur as a result of a dislodged tooth becoming jammed between cones, or between a cone and the body of the rock bit, thereby interfering with the rotation and cutting action of the cones involved, and of the bit. When cone rotation ceases, a skidding action occurs between the well bore bottom and the cone or cones, and a stopped cone quickly causes self-destruction of the cutting apparatus. Thus, an improved system, a method, and apparatus for enhanced cutting element retention and support in a rock bit would be desirable.

BRIEF SUMMARY

Embodiments of a system, method, and apparatus for enhanced cutting element retention and support in a rock bit are disclosed. The rock bit has pockets formed in it for the installation of cutting elements (e.g., compacts). Portions of the pockets are carburized to increase a yield strength of the pockets, which also increases the retention of the compacts. A material such as an incompressible fluid is placed in each pocket and acts to homogenize support for the cutting elements during operation of the rock bit. This feature also has the advantage of inhibiting or reducing the formation of cracks in the rock bit.

In one embodiment, the pockets are milled into the roller cones of a rock bit. The pockets are milled prior to heat treatment of the roller cones. The pockets are formed at a diameter that is slightly smaller than an outer diameter of the compacts. Portions of the pockets are then carburized. The roller cones are heated until the diameter of the pockets is equal to the outer diameter of the compacts. After the roller cones have cooled and been cleaned, a small amount of oil is inserted at each bottom of the pockets and the compacts are then pressed into their places. Subsequent heat treatment is used to exploit the carburization.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention are attained and can be understood in more detail, a more particular description of the invention briefly summarized above may be had by reference to the embodiments thereof that are illustrated in the appended drawings. However, the drawings illustrate only some embodiments of the invention and therefore are not to be considered limiting of its scope as the invention may admit to other equally effective embodiments.

DETAILED DESCRIPTION

Referring to FIGS. 1 through 4, embodiments of a system, method and apparatus for enhanced cutting element retention and support in a rock bit are disclosed. The invention is well suited for many types of rock bits including roller cone drill bits and fixed blade drill bits.

Figure 1:
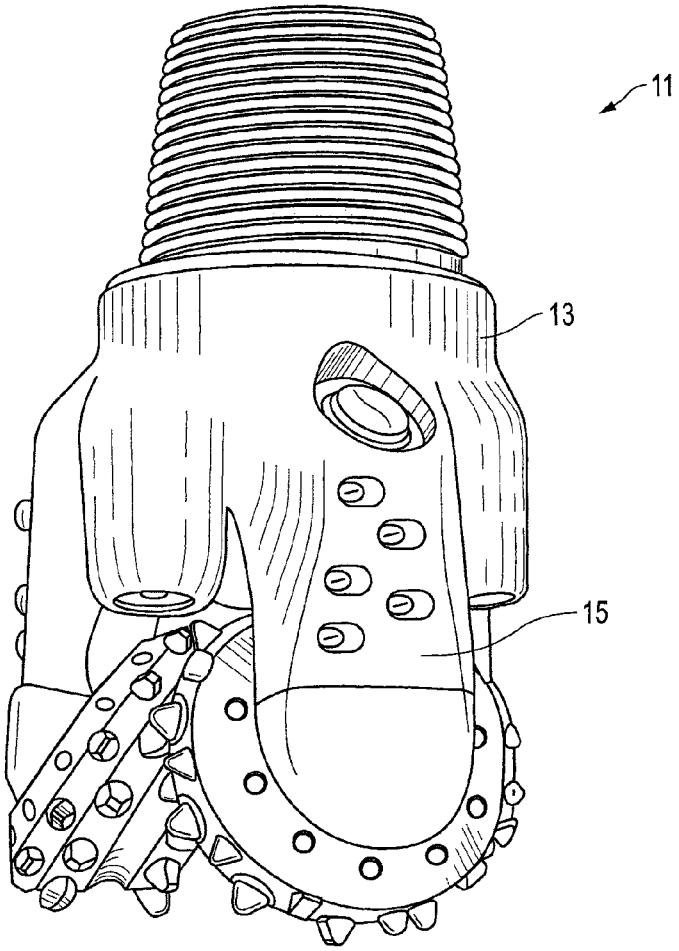
FIG. 1 is an isometric view of one embodiment of a roller cone rock bit constructed in accordance with the invention.
Figure 2:
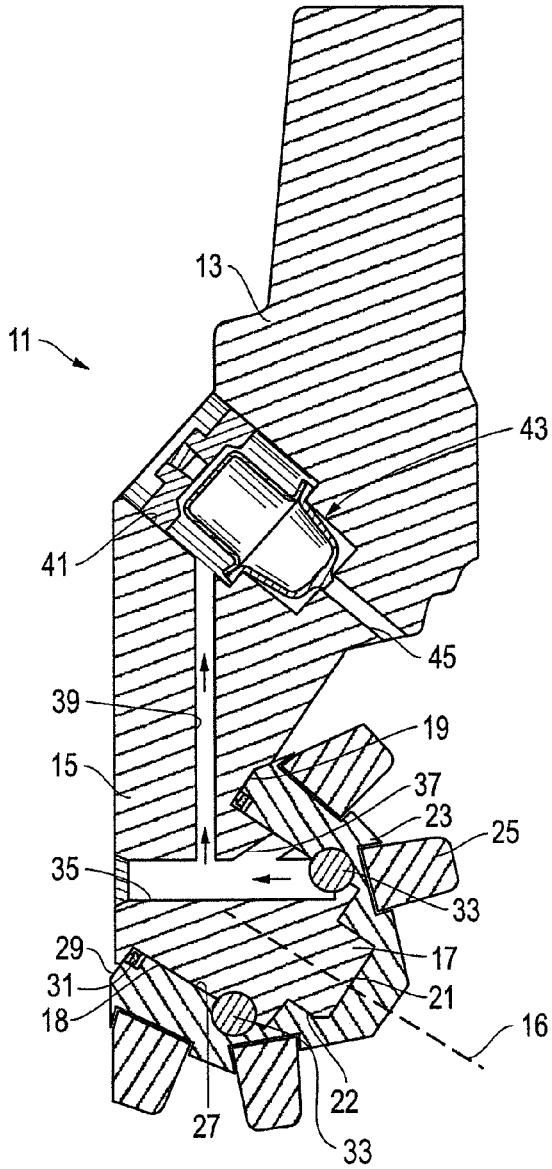
FIG. 2 is a sectional view of a leg of the roller cone rock bit of FIG. 1.

For example, FIGS. 1 and 2 illustrate one embodiment of a rock bit 11 having a body 13 with a threaded upper end for attachment to the lower end of a drill string (not shown). Body 13 has at least one bit leg 15 (e.g., each rock bit 11 typically has three bit legs 15) that extend downward from it. Each bit leg 15 (one depicted in FIG. 1 for clarity) has a bearing pin 17 (FIG. 2) that extends downward and inward along an axis 16. Bearing pin 17 has an outer end, referred to as the last machined surface 19, where it joins bit leg 15.

In the embodiment shown, bearing pin 17 has a main journal surface 18 and a nose 21 having a smaller diameter than journal surface 18 that is formed on its inner end. Nose 21 also has a pilot pin radial bearing surface 22 that is parallel to journal surface 18 relative to axis 16. In another embodiment (e.g., for larger diameter bits), roller bearings may be used instead of journal bearings. The invention is well suited for both types of applications.

A roller cone 23 is rotatably mounted to bearing pin 17. Roller cone 23 has a plurality of cutting elements 25 mounted thereto and protruding therefrom. Roller cone 23 has a cavity 27 that is slightly larger than an outer diameter of bearing pin 17. Roller cone 23 may be retained in more than one manner. In the embodiment shown, roller cone 23 is retained on bearing pin 17 by a plurality of balls 33 that engage a mating annular recess formed in cavity 27 of roller cone 23 and on bearing pin 17. The plurality of balls 33 lock the roller cone 23 to bearing pin 17 and are inserted through a ball passage 35 during assembly after roller cone 23 is placed on bearing pin 17. Ball passage 35 extends to the exterior of bit leg 15 and may be plugged as shown after the plurality of balls 33 is installed.

In the illustrated embodiment, a portion of cavity 27 slidingly engages journal surface 18 and radial bearing surface 22. The outer end of journal surface 18 is at a junction with a gland area engaged by a seal 31, and the inner end of journal surface 18 is considered to be at a junction with a groove or race for the plurality of balls 33. Journal surface 18 and radial bearing surface 22 serve as a journal bearing for loads imposed along the axis of rock bit 11. Again, other types of drill bits may utilize roller bearings instead of journal bearing surfaces and are readily configured for the invention.

In a sealed lubricated bearings embodiment, a lubricant port 37 is located on an exterior portion of journal surface 18 of bearing pin 17. The lubricant port 37 is connected to a passage 39 via ball passage 35. Passage 39 leads to a lubricant reservoir 41 that contains a lubricant. Lubricant reservoir 41 may be of a variety of types. In one embodiment, an elastomeric diaphragm 43 separates lubricant in lubricant reservoir 41 from a communication port 45 that leads to the exterior of body 13. Communication port 45 communicates the hydrostatic pressure on the exterior of rock bit 11 with the elastomeric diaphragm 43 to reduce and preferably equalize the pressure differential between the lubricant and the hydrostatic pressure on the exterior of body 13. Roller cone 23 also has a back face 29 that is located adjacent, but not touching, last machined surface 19.

Figure 3:
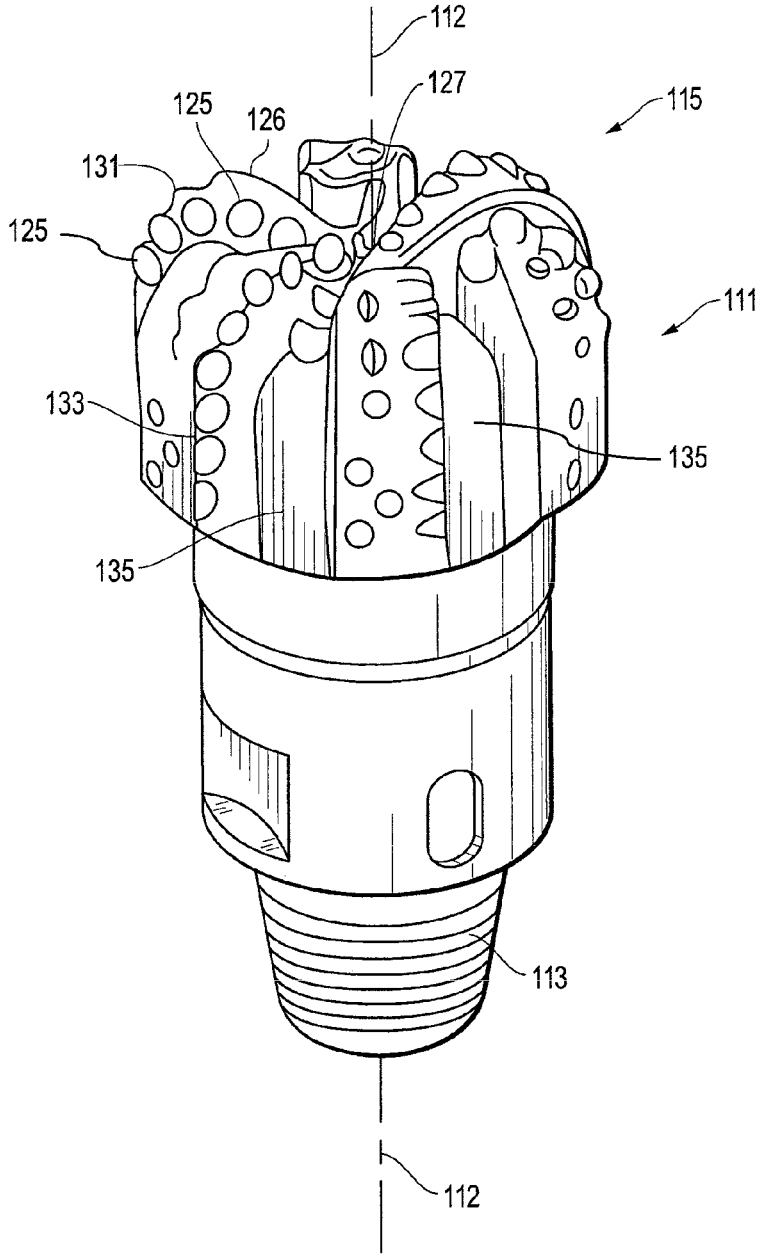
FIG. 3 is an isometric view of another embodiment of an earth-boring bit constructed in accordance with the invention.

FIG. 3 depicts an isometric view of an embodiment of a fixed-cutter rotary drill bit 111. Drill bit 111 has a rotational axis 112 and a threaded end 113 for connection into a drill string (not shown). A cutting end 115 with a series of blades (e.g., six blades shown) at a generally opposite end of the drill bit 111 is provided with a plurality of hard cutting elements 125 (e.g., polycrystalline diamond cutters, etc.) arranged about cutting end 115 to effect efficient removal or cutting of formation material as the drill bit 111 is rotated in a borehole.

The cutting elements 125 are each secured in a pocket provided on cutting end 115 such that they engage formation material. Cutting elements 125 may comprise many different shapes, such as a frustoconical cutting element having a beveled edge. Cutting elements 125 may act somewhat like a plow that generally directs a high percentage of the material of the formation up a flat face of each cutting element 125.

The arrangement of cutting elements 125 on each blade of the drill bit 111 is configured in an overall cutting profile about rotational axis 112 of drill bit 111. Starting at rotational axis 112 and moving toward the outer diameter of drill bit 111, the cutting profile includes a cone 127, a nose 126, a shoulder 131, and a gage pad or surface 133. The gage pad 133 essentially defines the flat, outer diameter portion of drill bit 111 that extends from cutting end 115 and is proximal to and contacts the sidewall of the borehole during drilling operation of drill bit 111. A plurality of channels or junk slots 135 extends from cutting end 115 through gage pad 133 to provide a clearance area for the removal of cuttings and chips formed by cutting elements 125.

Figure 4:
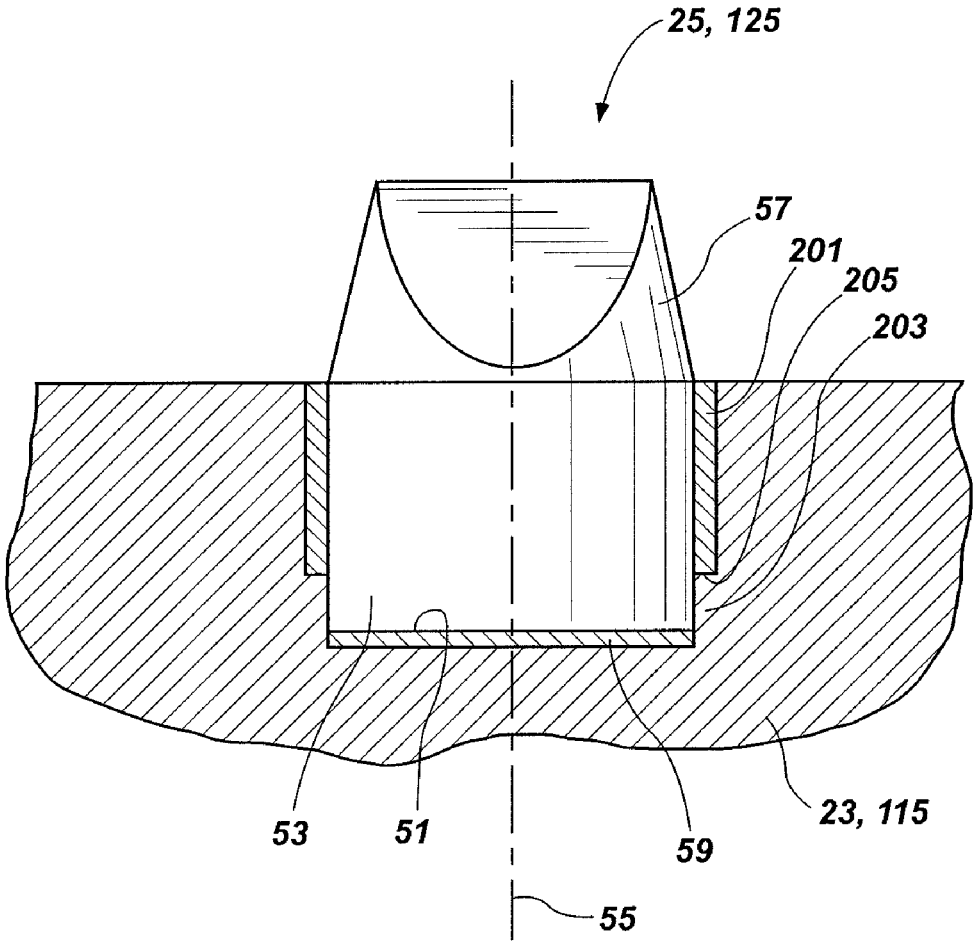
FIG. 4 is a schematic, sectional side view of one embodiment of a roller cone and a cutting element constructed in accordance with the invention.

Referring now to the enlarged view of FIG. 4, each cutting element 25, 125 is mounted in a pocket 51 formed in either the cones (e.g., the roller cone 23) or blades (e.g., the cutting end 115 of blades) of the bits. The pocket 51 may include a first carburized portion 201, a second un-carburized portion 203, and an interface 205 between the two, as is described in further detail below. The cutting element 25, 125 may be provided with a cylindrical base 53 with an axis 55 and a cutter 57 affixed thereto. The cutting element 25, 125 also may be provided with a substrate extension that may be formed from the same material as the cylindrical base 53. The substrate extension is secured to the cylindrical base 53 opposite the cutter 57.

A fluid 59, such as an incompressible fluid comprising a lubricant, oil, or grease is placed between a bottom of the pocket 51 and the cylindrical base 53 of the cutting element 25, 125. The fluid 59 acts as a homogenizing support for the cutting element 25, 125 during operation of the rock bit. The fluid 59 also reduces the formation of cracks in the rock bit during operation of the rock bit. The presence of fluid 59 in the pocket 51 forms a hydrostatic load that evenly distributes forces between the bottom of the pocket 51 and the cutting element 25, 125. Alternatively, a disk, such as a flat plastic disk or deformable metallic disk, may be used in lieu of fluid for the same purposes.

The invention also comprises a method of forming a rock bit. In one embodiment, the method begins as indicated and comprises providing a rock bit with cutting elements, such as cylindrical bodied cutting elements. Pockets are formed (e.g., cylindrical pockets) in the rock bit for the cutting elements, such that the pockets have a first diameter that is smaller (e.g., about 0.060 inch) than the cutting elements (e.g., a diameter of the cylindrical portion of the cutting elements). The pockets may be milled in the rock bit.

The pockets may be carburized and heated such that the pockets expand to a second diameter that is approximately equal to the diameter of the cutting elements. Carburization is a diffusion process to augment a material with carbon. Only the surfaces of the workpieces are carburized to locally change their metallurgical properties. This process may comprise carburization, air cooling, heating the roller cone or bit, austentizing, oil quenching (hardening), and tempering. This processing increases a yield strength of the pockets and increases retention of the cutting elements in the pockets.

Subsequent to carburizing, heat treatment is used in some embodiments to exploit the carburization. For example, the components may be austenitized, oil quenched and tempered to realize an improvement in yield strength. The pockets may be plastically formed rather than machined if the as-carburized gradient was satisfactory and no stock had to be removed, and if the pockets were shrunk about an undersized displacement. In one embodiment, the invention may comprise: forming undersized pockets; carburizing selected portions of the pocket interior; removing the machining stock; austenitizing, oil quenching, and tempering; finishing machining of the part (including the pockets); and either shrink fitting (e.g., under tempering temperature constraints) or press fitting the compacts or cutting elements.

Thereafter, a fluid is placed in each of the bottoms of the pockets before the cutting elements are installed in (e.g., pressed into) the pockets. As described herein, the fluid may comprise an incompressible fluid selected from the group consisting of a lubricant, oil, and grease, and the fluid acts as a homogenizing support for the cutting elements during operation of the rock bit, as well as reducing the formation of cracks in the rock bit during operation of the rock bit.

In one type of roller cone bit embodiment, the method may comprise providing a rock bit with roller cones, and cutting elements having cylindrical bodies with a diameter; forming pockets in the roller cones to a first axial depth with a first bottom (e.g., about half way to a final axial depth), the pockets having a cylindrical shape with a first diameter that is smaller than the diameter of the cutting elements, the pockets also having corners at surfaces of the roller cones; carburizing interior portions of the pockets at the first axial depth (i.e., on the initially formed temporary "bottom" and the sidewall portions 201 (FIG. 4) surrounding the first bottom, but not the corners of the pocket) to form so-called "circumferential waistbands" of carburization about interior walls of the pockets at the first depth; cooling the roller cones; deepening the pockets to a second axial depth having a second (and final) bottom, such that the circumferential waistbands of carburization remain in the pockets and any carburization on the first bottom is removed.

Yield strength for a carburized, quenched and tempered surface will be a function of the carbon content. Also, notch sensitivity will rise with a reduced carbon content. Thus, if a portion of the carbon gradient is removed, the sensitivity of the pocket material to cracking during the insertion of the compact will be reduced. The yield strength and toughness can be tailored by removing a portion of the carburized case.

In a next step, the roller cones are heated (e.g., austentizing, oil quenching and tempering the roller cones). In a shrink fitting embodiment, the roller cones are heated to expand the pockets to a second diameter that is approximately equal to the diameter of the cutting elements. The heating step increases a yield strength of the pockets and increases retention of the cutting elements in the pockets.

The method of the present invention also comprises cooling and cleaning the cutting elements and the pockets of the roller cones; placing a material (e.g., fluid or disks) on each of the second bottoms of the pockets; and then installing (e.g., pressing) the cutting elements in the pockets to form roller cone assemblies such that the material is located between each of the second bottoms and bottoms of the cutting elements. The roller cones are not necessarily heat treated, and the pockets may be milled into the roller cones: The method also may further comprise machining the circumferential waistbands of carburization to a selected thickness.

While the invention has been shown or described in only some of its forms, it should be apparent to those skilled in the art that it is not so limited, but is susceptible to various changes without departing from the scope of the invention.

What is claimed is:

1. An earth-boring tool, comprising:

a body including a plurality of surfaces defining at least one pocket extending to an axial depth within the body, the plurality of surfaces comprising:

an interior bottom surface; and a generally cylindrical interior surface extending from an exterior surface of the body to the interior bottom surface, the generally cylindrical interior surface comprising:

a first carburized annular portion extending from the exterior surface of the body to an intermediate depth within the at least one pocket; and a second un-carburized annular portion extending from the intermediate depth within the at least one pocket to the interior bottom surface;

a cutting element installed in the at least one pocket; and a material disposed within the at least one pocket between a base of the cutting element and the interior bottom surface.

2. The earth-boring tool of claim 1, wherein the material disposed within the at least one pocket comprises a disk of plastic or metal.

3. The earth-boring tool of claim 1, wherein the material disposed within the at least one pocket comprises an incompressible fluid.

4. The earth-boring tool of claim 3, wherein the incompressible fluid comprises at least one of a lubricant, oil, and grease.

5. The earth-boring tool of claim 1, wherein the material disposed within the at least one pocket is at least one of configured and formulated to reduce formation of cracks in the earth-boring tool during operation thereof.

6. The earth-boring tool of claim 1, wherein the cutting element is press fitted within the at least one pocket.

7. The earth-boring tool of claim 1, wherein the cutting element is shrink fitted within the at least one pocket.

8. The earth-boring tool of claim 1, wherein the body comprises austenitized steel.

9. The earth-boring tool of claim 1, wherein the intermediate depth is located about half way between the exterior surface of the body and the interior bottom surface.

10. The earth-boring tool of claim 1, wherein the body comprises a blade of a fixed blade drill bit.

11. The earth-boring tool of claim 1, wherein the body comprises a roller cone of a rock bit.

12. A rock bit, comprising:

a roller cone including a plurality of surfaces defining at least one pocket extending to an axial depth within the roller cone, the plurality of surfaces comprising:

an interior bottom surface; and at least one interior lateral surface extending from an exterior surface of the roller cone to the interior bottom surface, wherein the at least one interior lateral surface comprises:

a first carburized portion extending from the exterior surface of the roller cone to an intermediate depth within the at least one pocket; and a second un-carburized portion extending from the intermediate depth within the at least one pocket to the interior bottom surface;

a cutting element installed in the at least one pocket; and a material disposed within the at least one pocket between a base of the cutting element and the interior bottom surface.

13. The rock bit of claim 12, wherein the material disposed within the at least one pocket comprises a disk of plastic or metal.

14. The rock bit of claim 12, wherein the material disposed within the at least one pocket comprises an incompressible fluid.

15. The rock bit of claim 14, wherein the incompressible fluid comprises at least one of a lubricant, oil, and grease.

16. The rock bit of claim 12, wherein the material disposed within the at least one pocket is at least one of configured and formulated to reduce formation of cracks in the roller cone when drilling with the rock bit.

17. The rock bit of claim 12, wherein the cutting element is press fitted within the at least one pocket.

18. The rock bit of claim 12, wherein the cutting element is shrink fitted within the at least one pocket.

19. The rock bit of claim 12, wherein the body comprises austenitized steel.

* * * * *